US009666317B2

(12) United States Patent
Culbertson et al.

(10) Patent No.: US 9,666,317 B2
(45) Date of Patent: May 30, 2017

(54) RADIATION SHIELD WITH MAGNETIC PROPERTIES

(71) Applicant: AMERICAN CERAMIC TECHNOLOGY, INC., Poway, CA (US)

(72) Inventors: Richard V Culbertson, Poway, CA (US); Randall M Ragan, Rancho Santa Fe, CA (US); Joseph J Stupak, Portland, OR (US)

(73) Assignee: American Ceramic Technology, Inc., Poway, CA (US)

( * ) Notice: Subject to any disclaimer, the term of this patent is extended or adjusted under 35 U.S.C. 154(b) by 0 days.

(21) Appl. No.: 14/677,556

(22) Filed: Apr. 2, 2015

(65) Prior Publication Data

US 2015/0287486 A1 Oct. 8, 2015

Related U.S. Application Data

(60) Provisional application No. 61/974,298, filed on Apr. 2, 2014.

(51) Int. Cl.

| | |
|---|---|
| ***G21F 3/00*** | (2006.01) |
| ***G21F 1/10*** | (2006.01) |
| ***G21F 1/12*** | (2006.01) |

(52) U.S. Cl.

CPC ..... *G21F 3/00* (2013.01); *G21F 1/103* (2013.01); *G21F 1/106* (2013.01); *G21F 1/125* (2013.01)

(58) Field of Classification Search

USPC ..... 250/515.1, 516.1, 517.1, 519.1

See application file for complete search history.

(56) References Cited

U.S. PATENT DOCUMENTS

| | | | | |
|---|---|---|---|---|
| 3,864,124 | A * | 2/1975 | Breton | B01J 37/00 156/89.28 |
| 4,766,608 | A | 8/1988 | Cusick | |
| 5,525,408 | A | 6/1996 | Weir | |
| 5,745,925 | A | 5/1998 | Ghilardi | |
| 5,908,884 | A | 6/1999 | Kawamura | |
| 6,869,683 | B2 * | 3/2005 | Sakurai | B32B 25/20 428/447 |
| 7,274,031 | B2 | 9/2007 | Smith | |
| 7,815,820 | B2 * | 10/2010 | Tan | H05K 9/0083 250/515.1 |
| 2010/0176317 | A1 * | 7/2010 | Smith | B32B 1/08 250/518.1 |

* cited by examiner

*Primary Examiner* — Phillip A Johnston
(74) *Attorney, Agent, or Firm* — Amy Allen Hinson; Nexsen Pruet, LLC

(57) ABSTRACT

A radiation attenuation shield, method, and system are disclosed. The shield includes a polymer, a radiation attenuating material, and a magnetic material. The radiation attenuating material and the magnetic material may be dispersed within the polymer to form an attenuation layer. Further, a magnetic material layer may be positioned adjacent to the attenuation layer or encase the attenuation layer. The radiation attenuation shield may be made by combining the components to create a mixture and then inserting the mixture in a mold until a solidified shape is formed. Moreover, the radiation attenuation shield of the present invention may be mechanically secured to a structure to contain radiation. Further, the shield may be secured to a structure by using the magnetic properties of the shield.

33 Claims, 5 Drawing Sheets

RADIATION SHIELD WITH MAGNETIC PROPERTIES

CROSS-REFERENCE TO RELATED APPLICATIONS

This application is related to and claims priority to U.S. Provisional Patent Application No. 61/974,298 filed Apr. 2, 2014, which is incorporated herein by reference.

BACKGROUND

The present invention relates generally to systems and methods for attenuating radiation. More particularly, the invention relates to the field of radiation shields composed of a polymer, a magnetic material, and an attenuating material wherein the attenuating material is dispersed throughout the polymer.

A variety of systems have been used to protect individuals and equipment from the harmful effects of radiation. For example, inventions in the medical fields have utilized heavy and relatively stiff lead shields placed upon patients and medical workers to protect against the harmful effects of medical processes that emit radiation for analysis and treatment.

In nuclear power plants, the amount of radiation received by personnel is closely monitored. When radiation exposure doses reach a certain level, personnel are forced to cease working for a period thereby causing significant down time. A traditional solution to the problem of radiation exposure within nuclear power plants has been lead wool blankets or lead sheets. Lead wool blankets are used to temporarily or permanently make shield walls wrap pipes and, other pieces of equipment which emit radiation, or house equipment such as valves, etc., thereby limiting the intensity of radiation that escapes from the sources. Lead presents an environmental issue and as such is difficult and costly to dispose of. Polymer-based radiation shields have also been used in nuclear power plants. Like lead blankets, traditional polymer-based radiation shields are secured to the objects they are shielding such as by clamps, hooks or ties. Both lead blankets and polymer-based radiation shields are often cumbersome to transport and time-consuming to install and remove.

While various cumbersome methods and systems are known for protecting against harmful radiation, there is a need for an effective quick and easy to install system and method for protecting individuals from the harmful effects of radiation.

SUMMARY

The present invention includes a radiation attenuation shield. In one embodiment of the invention, the radiation shield is composed of a polymer, a radiation attenuating material, and a magnetic material. In another embodiment of the invention, the radiation shield is composed of 10 to 70 percent by volume of magnetic material, 5 to 55 percent by volume of attenuating material, and 20 to 85 percent by volume of polymer. The radiation attenuating material and magnetic material may be dispersed within the polymer to form an attenuation layer of the shield. Further, a magnetic material layer may be positioned adjacent to or encase the attenuation layer.

The present invention further includes a method for making a radiation attenuation shield. In one embodiment of the invention, the method includes the steps of combining a polymer, a radiation attenuating material, and a magnetic material to create a mixture, inserting the mixture into a mold, allowing the mixture to set or solidify to create a solidified mixture, and removing the solidified mixture from the mold. The method may further include the steps of combining the polymer with a catalyst and/or curing the mixture.

The present invention also includes a system for attenuating radiation. In one embodiment of the invention, the system includes the steps of providing a radiation attenuation shield composed of a polymer, a radiation attenuating material, and a magnetic material and securing the radiation attenuation shield to a structure. In this embodiment, the radiation shield limits radiation exposure surrounding the system by limiting radiation from exiting the shield.

DETAILED DESCRIPTION OF REPRESENTATIVE EMBODIMENTS

Figure 1:
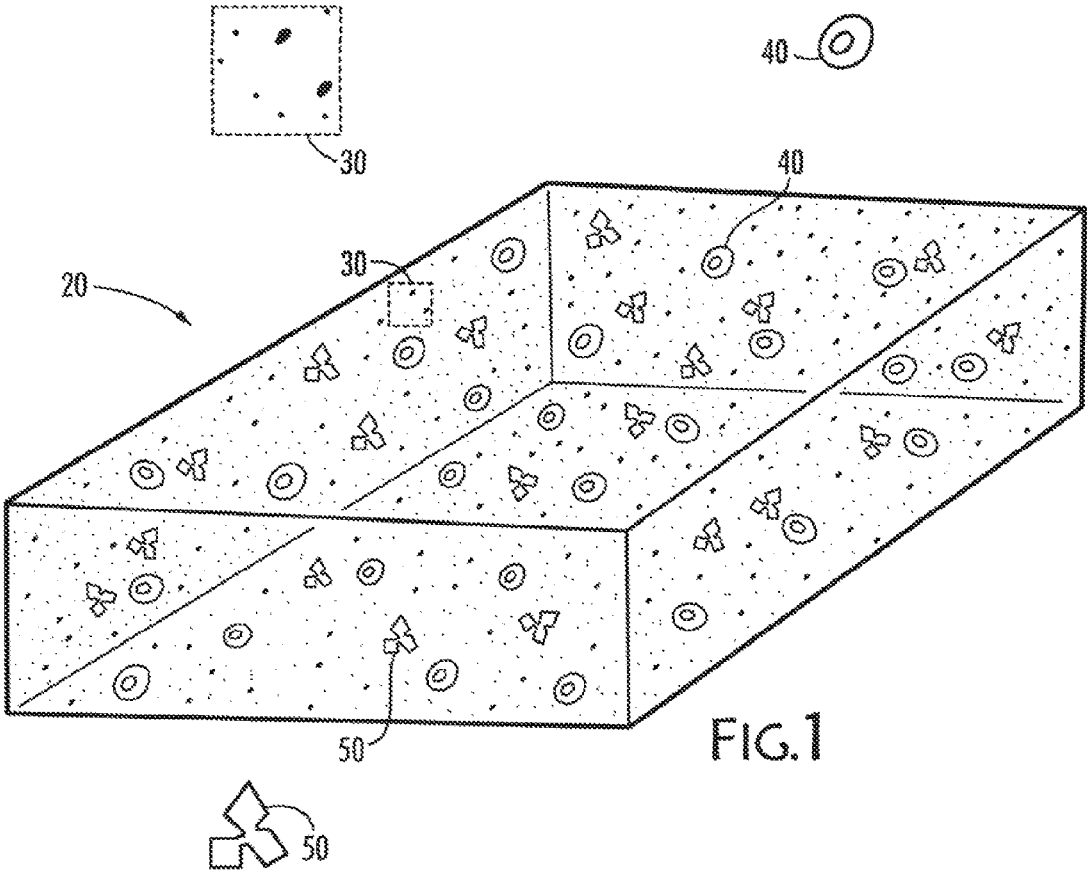
FIG. 1 is a perspective view of an embodiment of a radiation shield of the present invention.

The present invention relates to radiation shielding and a system and method of radiation shielding. The radiation shield of the present invention preferably includes a polymer, a radiation attenuating material, and a magnetic material. The ratio, composition, and dispersion of the particular composition of the radiation shield may vary depending upon preferred flexibility, radiation attenuating ability, magnetic attractive force needed, and allowed component or system weight. Although primarily described herein in terms of its use as a radiation shield, it will be clear that the radiation shield and system of the present invention may provide additional attenuation and vibration damping and/or thermal insulation benefits. Further, the primary components of the radiation shield as described herein may be combined with additional components, additives, and compounds without departing from the spirit and the scope of the present invention.

As discussed above, the radiation shield of the present invention is generally composed of at least three primary components: a polymer, a radiation attenuating material and a magnetic material. Further, the radiation shield is preferably constructed in sheets form or in layers and may comprise a single dispersed composite layer having all three primary components or multiple layers having dispersed composite layers and/or distinct component layers.

Example suitable polymers include both natural rubbers and synthetic rubbers. The flexibility of synthetic rubbers, also known as elastomers, may make synthetic rubbers more preferred for certain applications. An example of a particularly preferable polymer is liquid silicone rubber, which, after a catalyst is added to the formulation, may be heat cured or air cured to a flexible solid. Heat cured liquid silicone rubbers may be preferable when the radiation shield must be manufactured with short setting time constraints. Silicone elastomer liquids that accept greater volume percent loadings of radiation attenuating and/or magnetic material powders are also highly preferred. Such silicones typically have lower viscosities (e.g., 10,000 cps-40,000 cps), limited fillers (such as longer vinyl groups instead of shorter vinyl groups), and no fumed silica. Example liquid silicone rubbers for use in the radiation shield of the present invention include Polymethylvinylsiloxane and Polydimethylsiloxane hydrogen terminated (hydrogen is terminated by using a silane for electron transport). Thixotropic liquid synthetic rubbers typically having viscosities at approximately 90,000 cps or higher are typically not preferred because the elastomer's filler content is already too high thereby reducing available electrons in the outer valence shell of the reactive groups comprising the polyorganosiloxanes. Such limited available electron density reduces the affinity/bonding capabilities of added powders.

To cure the chosen polymer, a catalyst may be initially added to the silicone such as before any of the "dry" materials are mixed in. Example catalysts include platinum, tin, palladium, rhodium, platinum-olefin complexes, dibutyltin dilaurate, and dibutyltin octoate. Platinum is a particularly preferable catalyst in many applications. A tin catalyst may be preferable when the polymer has a high sulfate content. Silicone to catalyst ratios typically vary according to reactive R groups in the polymer chain. In silicones, the polymer to catalyst ratio varies over a range of from 10:1 to 1:1. The active chemical composition of the catalyst fluid as produced is typically approximately 1-2% by volume. The remaining amount is frequently the result of a carrier polymer incorporated to allow the mixture to coalesce. The carrier polymer is preferably siloxane based, Si—O—Si—O—Si—O—Si—O—Si—R, and is typically not longer than 6 silicone molecules per polymer chain.

Suitable attenuating materials of the present invention include metals, which are particularly useful at shielding gamma rays, x-rays, and other energies of electromagnetic radiation; and/or ceramic materials, which are particularly useful at shielding neutron radiation. Examples of attenuating ceramic materials for neutrons include: boron carbide and aluminum trihydrate. Gadolinium is particularly effective for capturing neutrons. Examples of attenuating metals for gamma and x-rays include but are not restricted to bismuth, lead, tungsten, and iron. Particularly preferred attenuating metals include but are not restricted to tungsten, iron, and combinations thereof. Shielding materials for gamma radiation and for neutrons respectively may be blended together, used independently, or combined in layers.

Example magnetic materials of the present invention include ferrite magnetic compounds and other common magnetic materials used to produce conventional magnets. Additionally, rare earth magnetic alloys are suitable magnetic materials of the present invention. Particularly preferred rare earth alloys include neodymium (Nd), iron (Fe), boron (B), praseodymium (Pr), cobalt (Co), zirconium (Zr), titanium (Ti), and copper (Cu) including combinations thereof. Neodymium rare earth alloys are particularly preferred because of their strong magnetic strength when magnetized for use in securing heavy articles to carbon steel which is often beneficial in industrial applications. Praseodymium (Pr), lanthanum (La), gadolinium (Gd), samarium (Sm), and cerium (Ce) are rare earth alloying elements that may be incorporated into magnetic materials for attaching the radiation shields of the present invention.

In one embodiment of the present invention, the radiation attenuating materials and magnetic materials are approximately evenly dispersed by volume throughout a polymer material, such as silicone elastomer. In this embodiment, the even dispersion of materials creates uniform radiation attenuation ability and uniform magnetic force across/throughout the article comprising the polymer plus additions. FIG. 1 discloses an example embodiment of a radiation shield layer 20 wherein the radiation attenuating particles 50, such as iron particles, and magnetic particles 40 are approximately evenly dispersed throughout a silicone matrix polymer material 30.

Suspending hard and dense particles in a flexible matrix presents an array of challenges. Thus, to disperse attenuating materials and magnetic materials throughout the chosen polymer, the attenuating materials and magnetic materials are preferably in powder form prior to dispersion. Furthermore, to maximize radiation attenuation and magnetic ability of a shield, it may be preferable to increase the packing density of the powder(s) dispersed within the polymer. To increase powder density, a blend of large and small particles may be preferable. Common techniques used to produce fine metallic powders such as melt spraying, milling, and other atomization processes typically result in a powder with a particle size distribution that promotes maximum packing/loading within a polymer body. Further, common sources of radiation attenuating materials, such as pure metal and ceramic powders, and common sources for magnetic powder materials typically supply powders that have been found, upon experimentation, to work well for purposes of the present invention. In one embodiment, the radiation attenuating powders and magnetic powders include particles within the range between −200 Mesh and −325 Mesh.

A variety of shaped particles may be used without departing from the spirit and scope of the present invention. For example, powders provided by common suppliers using standard milling processes to create such powders typically result in random particle shapes and size distributions that work well with the present invention. In one embodiment, broad distribution of spheroidal powder particles is used.

The method used for uniformly mixing the attenuating and magnetic materials throughout the polymer may be any conventional methods used to disperse powders in polymers. In one embodiment, low shear mixing is used. In an alternative embodiment, high shear mixing is used. Because the particle sizes of the powders are generally small, low shear mixing is typically sufficient. Prior to incorporating the powder mate a the polymer and catalyst mate may be mixed. In one embodiment, the polymer and its catalyst are in liquid form when mixed and form a liquid polymer base. After the liquid polymer and catalyst are mixed to alter the liquid polymer base, the radiation attenuating and magnetic materials may be blended into the liquid polymer base. Depending on the desired consistency and/or viscosity, the powder materials are typically blended into the liquid polymer base and mixed until the powder is uniformly distributed throughout the liquid polymer. To maintain a low moisture content of the resulting attenuating shield mixture, the powder may be pre-heated before being added to the liquid polymer base. Such pre-heating typically improves the wetability of the polymer, such as silicone, when adding the dry powder materials.

After the above materials are mixed to form an attenuating shield mixture, the radiation shield may be formed into any desired shape including sheets, complex shaped valve covers and pipe fittings, spiral pipe wraps, or other unique shapes as required to meet industrial needs. In one embodiment, the attenuating shield mixture is simply poured into a mold (wood, metal, or polymer) and air cured at room temperature. As discussed above, depending on the polymer chosen, the mold may need to be heated if the silicone chosen requires heat to set it.

Once the materials have been mixed, formed, and cured as discussed above, the magnetic material and/or layer(s) may be magnetized. While the magnetic particles may be magnetized before mixing and/or forming, magnetizing the magnetic powder after mixing-in the particular magnetic powder with the selected polymer and forming the radiation shield via molding, for example, has several advantages. Magnetizing the magnetic composition particles after mixing and forming often simplifies the manufacturing process for the radiation shields and promotes an even distribution of the magnetic powder throughout the polymer because the agnetic powder is not magnetically attracted to other objects until after the magnetic particles are set within the cured polymer matrix.

The intended use of a particular radiation shield typically dictates the procedure and equipment used in the magnetization process; however, the concept is typically similar for all applications. For example, after the composite radiation shield is formed, the entire radiation shield including the magnetic material such as rare earth magnetic alloys are exposed to a preferably very strong magnetic field (e.g., Hs of 95% saturation of >20 kOe). In one embodiment, the magnetic pole orientation of the shield sheet includes a north-seeking pole (+) on one face and a south seeking poles (−) on the opposite face. In an alternative embodiment, the magnetic pole orientation of the shield includes north seeking poles (+) and south seeking poles (−) poles that are adjacent to one another on the same side of the sheet in alternating bands across the surface of the material. The particular design criteria and construction of the magnetizing fixture, and thus the orientation of the magnetic poles, are typically determined by the thickness and associated weight of the attenuating material to be adhered to the magnetic material and the gaps, paint, insulation, or other materials separating the magnetic layer and the ferrous material to which it is adhered. Similarly the thickness and weight of the magnetic composite layer itself, and/or the separation force the materials will be subjected to such as gravity or vibrational forces (seismic behavior) must also be accounted for. Other environmental and mounting factors may be considered as well without departing from the spirit and the scope of the present invention.

Magnetic strength or attractive forces exerted by the magnetic material portion of the present invention is a key consideration in constructing a magnetic radiation attenuating shield. Magnetic attraction is useful in mounting or attaching the radiation attenuating materials so as to provide shielding of a radiation source. Magnetic attraction may be between the present invention and a ferrous metal component, such as a rack or structure for mounting the protective product. Magnetic attraction is particularly important when shielding a stainless steel (not affected by a magnetic field) or nonmetal component. In this case magnetic attraction between two areas of the magnetic material is used to constrain the shielding in its desired position. For example, a strip of the radiation shielding of the present invention may be rewrapped around a component and held in the wrapped configuration without needing to apply a strap or other securing device. Application and installation of the present invention (Example: pipe wrap) can be done in a very short time (seconds), providing the attractive advantage of minimizing radiation dose exposure of workers.

Magnetic attractive force as provided by the present invention is present in two forms: 1) attraction between the invention and a ferrous metal component or a magnet (referred to as "attractive force"); and 2) attraction between two areas of the magnetic component of the present invention (referred to as "closing force"). Such attractive and closing force can be measured by using a meter (Example: Model 455 DSP Gaussmeter manufactured by Lake Shore Cryotronics, Westerville, Ohio). It has been found that the following minimums are preferable to facilitate the present invention being applied successfully in the field.

Flat Attractive Force: 700 Gauss

Closing Force: 1,400 Gauss

The particular radiation attenuating abilities of a radiation shield of the present invention may be adjusted to suit the particular application. Similarly, the magnetic ability of the shield may be adjusted to suit the needs of a particular application. Further, the specific weight and flexibility of the radiation shield may be adjusted depending on the particular requirements and restrictions of the shield application.

While the above method of forming a radiation shield teaches dispersion of both a magnetic material and an attenuating material within a polymer matrix such as shown in FIG. 1, alternative configurations are contemplated by the present invention. It is noted that magnet materials often possess attenuating capabilities so that up to 100% magnetic material can be used to provide a level of radiation attenuation. Indeed, the particular design of the radiation shield including the number of material layers, the composition of each layer, and the dimensions of each layer, depends on the particular application and the desired properties for the radiation shield.

Figure 2:
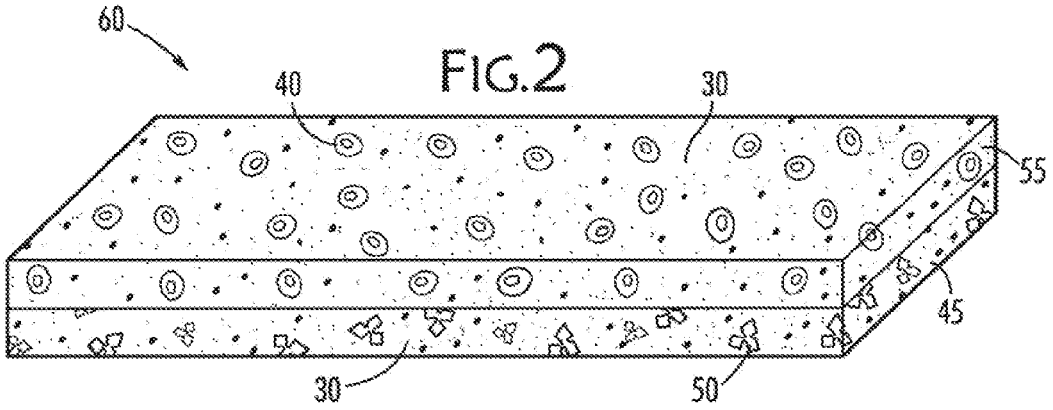
FIG. 2 is a perspective view of an embodiment of a two layer radiation shield of the present invention.

For example, in one embodiment of the present invention such as shown in FIG. 2, the radiation shield 60 includes a first layer 55, which is a polymer layer having magnetic material 40 dispersed throughout the polymer material 30, bonded to a second layer 45, which is a polymer layer having attenuating materials 50 dispersed throughout the polymer material 30. Incorporating a double layer shield with separate layers for attenuating material and magnetic material allows placement of the magnet layer close to both the magnetizing fixture and subsequently to the surface where the shield is ultimately adhered. This design further increases magnetic field strength since such strength drops off with the square of the distance of separation. In this embodiment, silicone polymers are particularly preferred because layers of silicone typically bond easily and well to each other.

In another embodiment, magnetic material may be dispersed throughout a smaller end portion of a polymer layer and then bonded to an end of a larger strip of polymer with iron dispersed throughout for radiation attenuation. The magnetic material dispersed throughout the smaller end of the entire sheet allows the sheet to wrap around an object and become secure by attraction to the remaining portion of the sheet due to the iron dispersed throughout the sheet.

Figure 3:
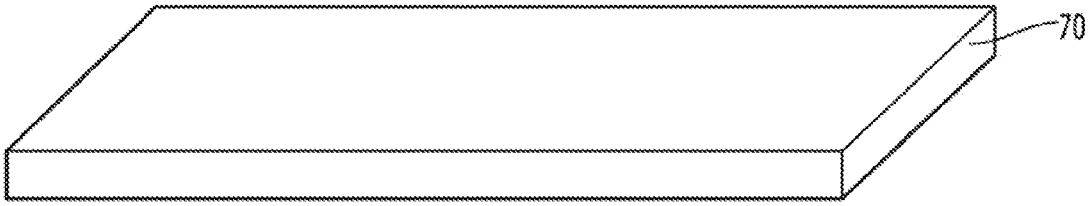
FIG. 3 is a perspective view embodiment of a single layer radiation of shield of the present invention.

In yet another embodiment, such as shown in FIG. 3, a single layer 70 radiation shield is contemplated. The single layer 70 may be composed of a polymer with attenuating material dispersed therethrough, a polymer with magnetic material dispersed therethrough, or a polymer layer with both attenuating material and magnetic material dispersed therethrough. Furthermore, the attenuating material and/or magnetic material may be evenly dispersed such as shown in FIG. 1 or dispersed in particular segments of the layer 70. In one embodiment, the single layer radiation shield of FIG. 3 is combined with additional layers to create a multi-layer radiation shield. In the radiation shield of FIG. 3, the length of the radiation shield layer 70 is approximately 36 inches and the width is approximately 12 inches and thickness of 0.50 inches.

Figure 4:
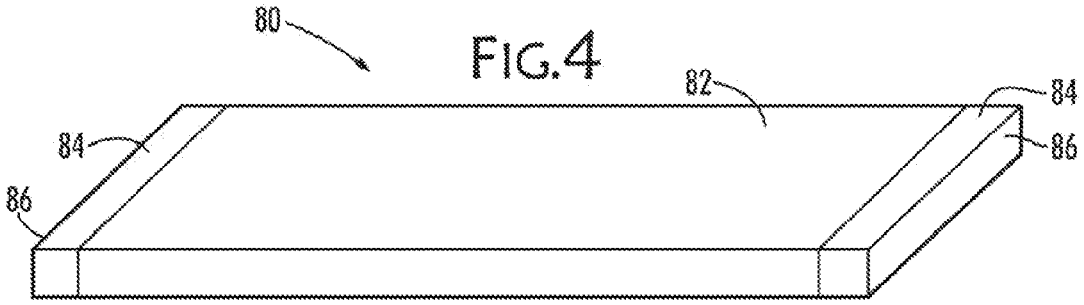
FIG. 4 is a perspective view of another embodiment of the present invention.

FIG. 4 discloses a single layer radiation shield 80 similar to the embodiment of FIG. 3 except that it includes a center shielding region 82 and magnetic ends 84. Like FIG. 3, the center portion 82 may be composed of a polymer with attenuating material dispersed throughout, a polymer with magnetic material dispersed throughout, or a polymer layer with both attenuating material and magnetic material dispersed throughout. Furthermore, the attenuating material and/or magnetic material may be evenly dispersed such as shown in FIG. 1 or dispersed in particular segments of the center region 82. Magnetic ends 84 are almost entirely, if not entirely, composed of magnetic material. In the radiation shield of FIG. 4, the length of the center region 82 of the radiation shield 80 is approximately 33 inches and the width is approximately 12 inches and 0.375 inches thick.

Figure 5:
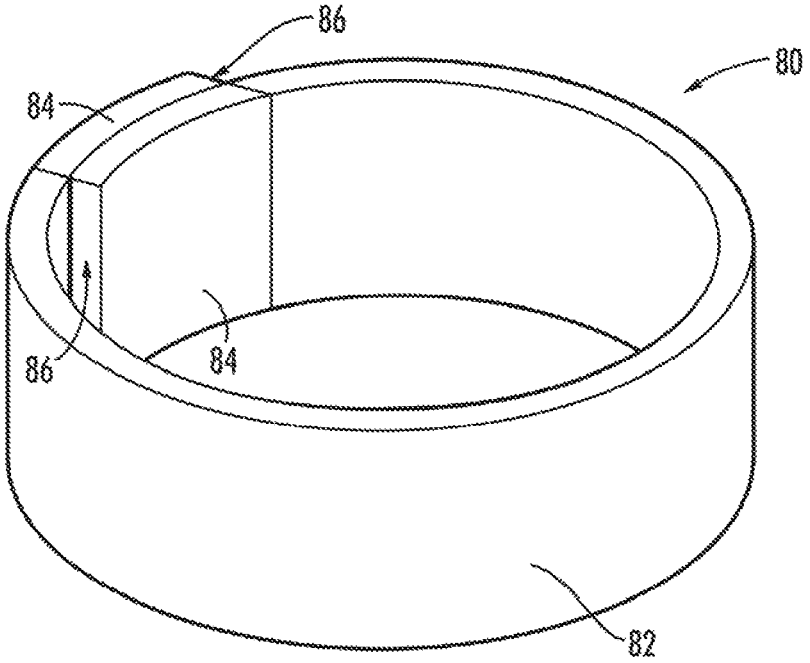
FIG. 5 is a perspective view of an embodiment of the radiation shield of the present invention connected at its ends.
Figure 6:
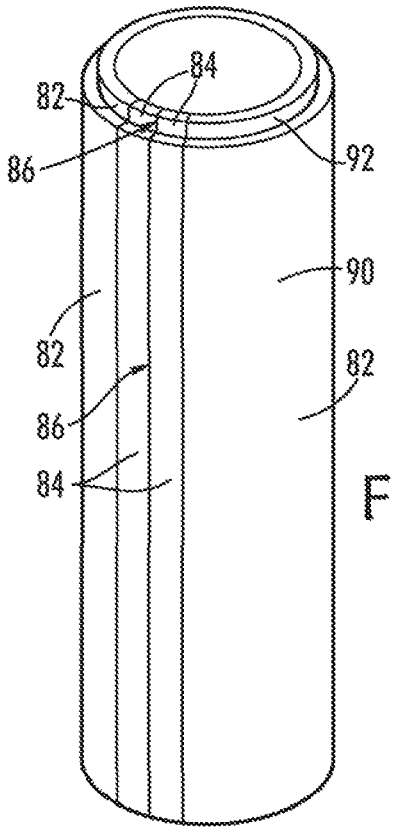
FIG. 6 is a perspective view of two radiation shields of the present invention positioned adjacent to each other and connected at their respective ends.

As shown in FIG. 5, the radiation shield, such as shown in FIG. 4, may be wrapped around an object and secured in place using the magnetic ends 84, which have a magnetic orientation causing them to lock together when overlapped. Alternatively, as shown in FIG. 6, the radiation shield, such as shown in FIG. 4 may be wrapped around an object and secured in place using the magnetic ends 84 but which have a magnetic orientation causing the endwalls 86 of the respective ends 84 to lock together without any overlapping. In the embodiment of FIG. 6, multiple radiation shield layers are incorporated including a first layer 90 and a second internal layer 92.

Figure 7:
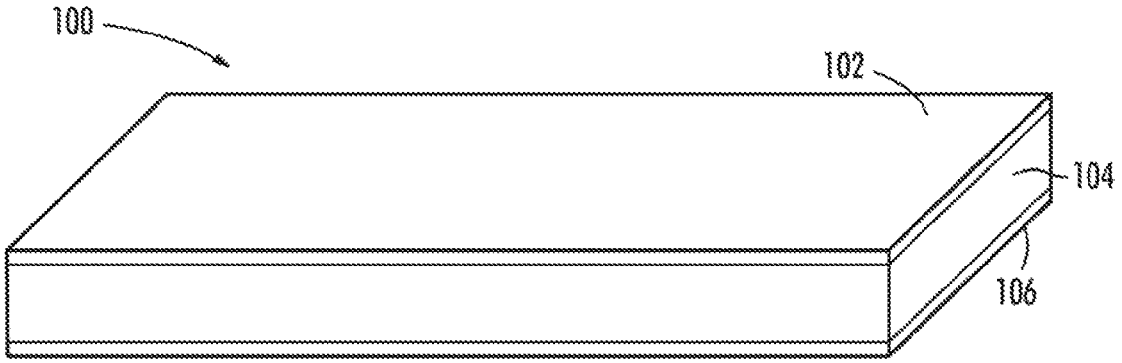
FIG. 7 is a perspective view of a three layer radiation shield of the present invention.

In yet a further embodiment of the present invention, such as shown in FIG. 7, the radiation shield 100 includes three bonded layers 102, 104 and 106. The center layer 104 may be composed of a polymer with attenuating material dispersed therethrough, a polymer with magnetic material dispersed therethrough, or a polymer layer with both attenuating material and magnetic material dispersed therethrough. Furthermore, the attenuating material and/or magnetic material may be evenly dispersed such as shown in FIG. 1 or dispersed in particular segments of the center region 82. The outer layers 102 and/or 106 may be composed similarly to center layer 104 or be composed of different materials than center layer 104. For example, in one embodiment, the outer layers 102 and 106 are almost entirely, if not entirely, composed of magnetic material so that the center layer 104 is sandwiched between two magnetic layers.

FIGS. 8 through 12 disclose several configurations of radiation shields of the present invention and various connection positions. The radiation shields of FIGS. 8 through 12 are only partially shown and may represent a single radiation shield wrapped around a body and then connected at its two ends or two separate radiation shields connected at a respective end of each shield.

Figure 8:
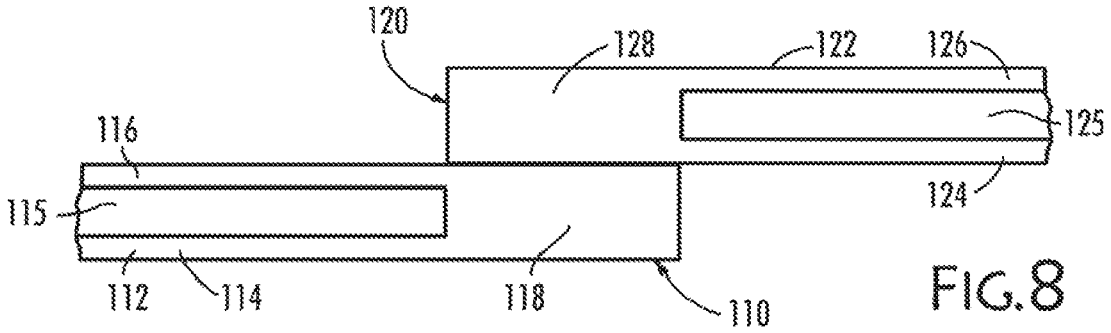
FIG. 8 is a side view of connected end portions of a radiation shield or two radiation shields of the present invention.
Figure 9:
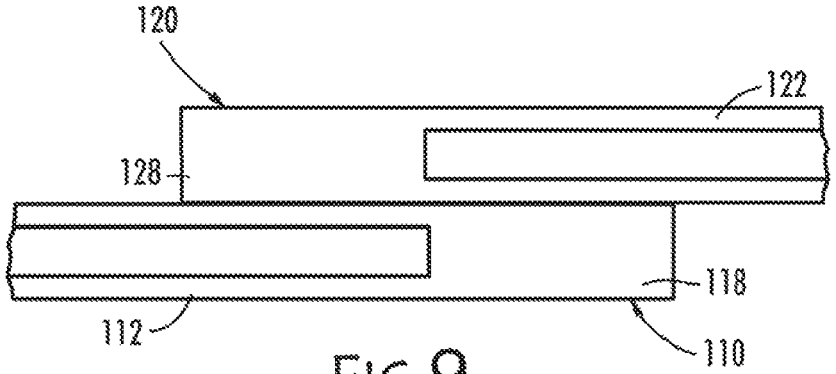
FIG. 9 is a side view of connected end portions of a radiation shield or two radiation shields of the present invention.

FIG. 8 discloses a first radiation shield end portion 110 and a second radiation shield end portion 120. Radiation shield end portion 110 includes a three layer section 112 and a single layer section 118. The three layer section includes outer layers 114 and 116 and center layer 115. Likewise, radiation shield end portion 120 includes a three layer section 122 and a single layer section 128. The three layer section includes outer layers 124 and 126 and center layer 125. In one embodiment, the outer layers 114, 116, 124, and 126 and single layer sections 118 and 128 of radiation shield end portions 110 and 120 are composed of primarily magnetic material while the center layers 115 and 125 are composed of composite materials including a polymer and attenuating material. In another embodiment, the outer layers 114, 116, 124, and 126 and single layer sections 118 and 128 of radiation shield end portions 110 and 120 are composed almost exclusively of magnetic material. Moreover, in yet another embodiment the center layers 115 and 125 are composed of composite materials including a polymer, attenuating materials and magnetic materials. Alternatively, the outer layers 114, 116, 124, and 126 and single layer sections 118 and 128 of radiation shield end portions 110 and 120 may be composed of any combination of polymer, magnetic material, and/or attenuating material. An alternative connection of radiation end portions 110 and 120 is disclosed in FIG. 9 wherein the single layer sections 118 and 128 are positioned adjacent to the three layer sections 112 and 122 as opposed to the configuration of FIG. 8 wherein the single layer sections 118 and 128 are adjacent to each other.

Figure 10:
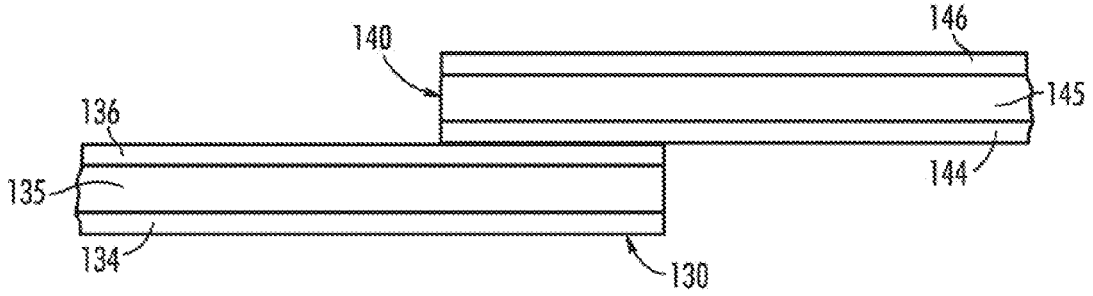
FIG. 10 is a side view of connected end portions of a radiation shield or two radiation shields of the present invention.

FIG. 10 discloses yet another configuration having a first radiation shield end portion 130 and a second radiation shield end portion 140. Radiation shield end portion 130 has three layers including outer layers 134 and 136 and center layer 135. Likewise, radiation shield end portion 140 has three layers including outer layers 144 and 146 and center layer 145. In one embodiment, the outer layers 134, 136, 144, and 146 are composed of primarily magnetic material while the center layers 135 and 145 are composed of composite materials including a polymer and attenuating material. Alternatively the center layers 135 and 145 may be composed of composite materials including a polymer, attenuating material, and magnetic material. Furthermore, the outer layers 134, 136, 144, and 146 may be composed of composite materials including a polymer, a magnetic material, and/or an attenuating material.

Figure 11:
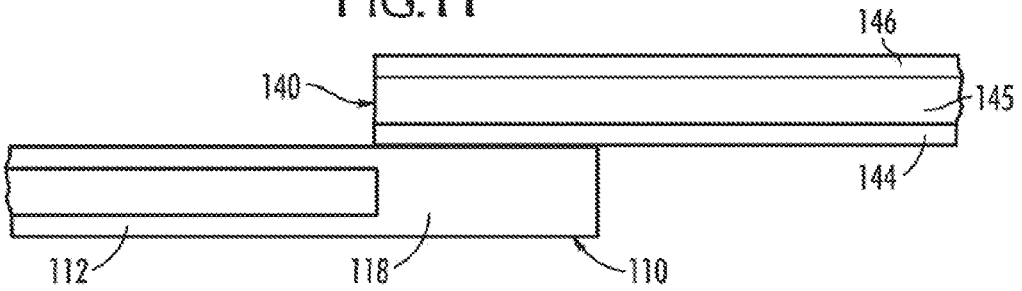
FIG. 11 is a side view of connected end portions of a radiation shield or two radiation shields of the present invention.
Figure 12:
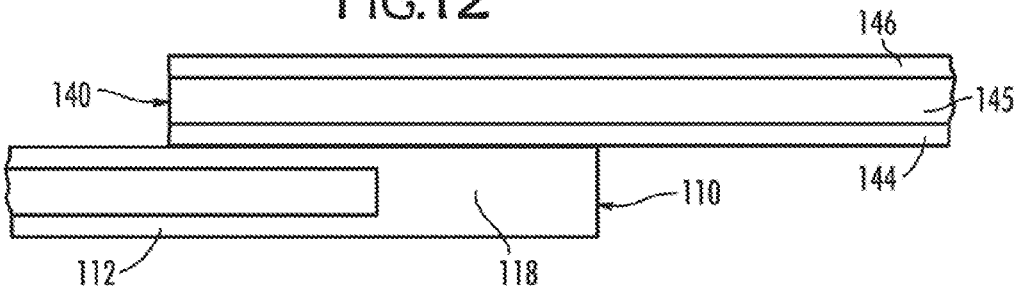
FIG. 12 is a side view of connected end portions of a radiation shield or two radiation shields of the present invention.

FIGS. 11 and 12 disclose the connection of distinct radiation shield end portions. For example, FIGS. 11 and 12 disclose a first radiation end portion similar to end portion 110 shown in FIGS. 8 and 9, which has a three layer section 112 and a single layer section 118, connected to a second radiation end portion similar to end portion 140 shown in FIGS. 10 and 11, which only has a three layer section 144, 145, 146. FIG. 11 discloses the end portions 110 and 140 connected only above the single layer section 118 of end portion 110. FIG. 12 on the other hand discloses the end portions 110 and 140 connected so that the single layer section 118 and the three layer section 112 of end portion 110 are adjacent to end portion 140

Radiation shields or radiation shield layers of the present invention may have the compositions as shown in Table I below. The example compositions as shown in Table I are particularly useful at attenuating gamma rays and the resulting shield and/or shield layer has an approximate radiation attenuation ability based upon the specified material thickness as also set forth in Table I below.

TABLE I

| Metal Radiation Shield Compositions | | | |
|---|---|---|---|
| Material | Percent by volume | Thickness | % Attenuation |
| Composition Example 1 | | | |
| Iron Powder | 25-50% | 1.25 in | 50 |
| Silicone | 50-75% | | |
| Composition Example 2 | | | |
| Tungsten Powder | 20-55% | 0.5 in | 50 |
| Silicone | 45-80% | | |
| Composition Example 3 | | | |
| Magnetic Powder | 15-70% | 0.5 in | 50 |
| Silicone | 30-85% | | |
| Composition Example 4 | | | |
| Iron Powder | 5-30% | 1 in | Median-20 |
| Magnetic Powder | 10-45% | | High-55 |
| Silicone | 20-85% | | |
| Composition Example 5 | | | |
| Tungsten Powder | 20-50% | 0.5 | Median-30 |
| Magnetic Powder | 10-50% | | High-60 |
| Silicone | 30-70% | | |
| Composition Example 6 | | | |
| Iron Powder | 10-25% | 0.5 | Median-35 |
| Tungsten Powder | 15-30% | | High-55 |
| Magnetic Powder | 15-40% | | |
| Silicone | 20-60% | | |
| Composition Example 7 | | | |
| Lead Powder | 20-50% | 0.5 | Median-35 |
| Magnetic Powder | 10-45% | | High-60 |
| Silicone | 20-85% | | |

A further example radiation shield or radiation shield layer of the present invention has the composition as shown in Table II below. The example composition as shown in Table II is particularly useful at attenuating neutrons and the resulting shield and/or shield layer has an approximate radiation attenuation ability based upon the specified material thickness as also set forth in Table II below.

TABLE II

| Ceramic Radiation Shield Composition | | | |
|---|---|---|---|
| Material | Percent by volume | Thickness | % Attenuation |
| Composition Example 8 | | | |
| Boron Carbide Powder | 10-20% | 2.5 in | Median-50 |
| Aluminum Trihydrate | 10-20% | | High-80 |
| Magnetic Powder | 10-35% | | |
| Silicone | 25-70% | | |

The above examples are for illustration only and are not intended to be all inclusive or limiting unless otherwise specified.

The magnetic abilities of the shields of the present invention preferably provide advantages by reducing the amount of time, effort, and materials needed to secure the shield to various objects and to remove the shield if used on a temporary basis. For example, the magnetic ability of the radiation shield may allow the shield to quickly and securely attach to ferrous and nonferrous metal and polymer objects (pipes for example) or completely wrap around an object (pipe for example) or be applied in applications other than pipe shielding; for example, in making shield walls. For pipes, the shield remains secure by overlapping portions of the shield and allowing the shield's inherent magnetic ability to serve as the fastening mechanism. Further, the ratio of polymer, attenuating material, and magnetic material may be customized to suit a variety of nuclear and other industry needs. The radiation shield can also vary in radiation attenuation ability, magnetic strength, flexibility, weight, thickness, and shape. The embodiments disclosed herein represent some of the preferred, effective ratios that meet demonstrated needs within different industries.

The materials used to provide the magnetic feature of the shield may also contribute to the radiation attenuating ability of the shield. This dual role assumed by many magnetic materials when incorporated in shields may help reduce weight and cost because as the amount of magnetic material used within a shield increases, the amount of attenuating material dispersed throughout the polymer may be decreased. This trade-off will be experienced in shields with tungsten radiation attenuating content.

The method of magnetizing the radiation shield may be used to affect the characteristics of the resulting magnetic field in the radiation shield. Those skilled in the art will appreciate the industry benefits of customizing the characteristics of the magnetic field and how such customization allows the shield to exhibit different magnetic abilities when being attached to various objects. Further, the radiation attenuating materials may be chosen so as to shield a selected radiation wavelength or a selected mix of radiation wavelengths. Gamma rays, neutrons, and other forms of radiation may be shielded depending on specific goals.

While various embodiments and examples of this invention have been described above, these descriptions are given for purposes of illustration and explanation, and not limitation. Variations, changes, modifications, and departures from the systems and methods disclosed above may be adopted without departure from the spirit and scope of this invention. In fact, after reading the above description, it will be apparent to one skilled in the relevant art(s) how to implement the invention in alternative embodiments. Thus, the present invention should not be limited by any of the above described exemplary embodiments.

Further the purpose of the Abstract is to enable the various Patent Offices and the public generally, and especially the scientists, engineers, and practitioners in the art who are not familiar with patent or legal terms or phraseology, to determine quickly from a cursory inspection the nature and essence of the technical disclosure of the application. The Abstract is not intended to be limiting as to the scope of the invention in any way.

What is claimed is:

1. A radiation attenuation shield comprising:

an attenuation layer formed from a composition comprising 20 to 85 percent by volume of a polymer; and 5 to 55 percent by volume of a radiation attenuating material, wherein the radiation attenuating material is dispersed within the polymer;

a first magnetic material layer; and a second magnetic material layer, wherein the first and second magnetic material layers encase the attenuation layer.

2. The radiation attenuation shield of claim 1, wherein the radiation attenuating material comprises at least one component of iron, tungsten, bismuth, bismuth oxide, lead, boron carbide, and aluminum trihydrate.

3. The radiation attenuation shield of claim 1, wherein the radiation attenuating material comprises two or more components of iron, tungsten, bismuth, bismuth oxide, lead, boron carbide, and aluminum trihydrate.

4. The radiation attenuation shield of claim 1, wherein the radiation attenuating material is tungsten.

5. The radiation attenuation shield of claim 1, wherein the radiation attenuating material is iron.

6. The radiation attenuation shield of claim 1, wherein the polymer is a liquid silicone rubber that is catalyzed to a flexible solid.

7. The radiation attenuation shield of claim 1, wherein the magnetic material comprises at least one of a rare-earth metal alloy, ferrite, and iron powder.

8. The radiation attenuation shield of claim 1, wherein the magnetic material comprises at least two of a rare-earth metal alloy, ferrite, and iron powder.

9. The radiation attenuation shield of claim 1, wherein the radiation attenuating material and magnetic material comprises a powder of particles no larger than −60 mesh.

10. The radiation attenuation shield of claim 1, wherein the radiation attenuation ability of the radiation attenuation shield is at least 19 percent.

11. The radiation attenuation shield of claim 1, wherein the magnetic material of the radiation attenuation shield has a flat attractive force of at least 700 gauss and a closing force of at least 1400 gauss.

12. The radiation attenuation shield of claim 1, wherein the attenuation layer further comprises a magnetic material.

13. The radiation attenuation shield of claim 1 further comprising a first end portion comprising primarily magnetic material.

14. The radiation attenuation shield of claim 13 further comprising a second opposing end portion also comprising primarily said magnetic material.

15. A radiation attenuation shield comprising 10 to 70 percent by volume of a magnetic material, 5 to 55 percent by volume of a radiation attenuating material, and 20 to 85 percent by volume of a polymer.

16. The radiation attenuation shield of claim 15, wherein the radiation attenuating material is chosen from the group of iron, tungsten, bismuth, bismuth oxide, lead, boron carbide, and aluminum trihydrate.

17. The radiation attenuation shield of claim 15, wherein the radiation attenuating material comprises tungsten.

18. The radiation attenuation shield of claim 15, wherein the radiation attenuating material comprises iron.

19. The radiation attenuation shield of claim 15, wherein the radiation attenuating material comprises a mixture of tungsten and iron.

20. The radiation attenuation shield of claim 15, wherein the polymer is a liquid silicone rubber that is catalyzed to a flexible solid.

21. The radiation attenuation shield of claim 15, wherein the magnetic material comprises at least one of a rare-earth metal alloy, ferrite, and iron powder.

22. The radiation attenuation shield of claim 15, wherein the magnetic material comprises at least two of a rare-earth metal alloy, ferrite, and iron powder.

23. The radiation attenuation shield of claim 15, wherein the radiation attenuating material and magnetic material comprises a powder of particles no larger than −60 mesh.

24. The radiation attenuation shield of claim 15, wherein the radiation attenuation ability of the radiation attenuation shield is at least 19 percent.

25. The radiation attenuation shield of claim 15, wherein the magnetic material of the radiation attenuation shield has a flat attractive force of at least 700 gauss and a closing force of at least 1400 gauss.

26. The radiation attenuation shield of claim 15, wherein the radiation attenuating material and the magnetic material are dispersed within the polymer to form an attenuation layer.

27. The radiation attenuation shield of claim 26 further comprising a magnetic material layer positioned adjacent to the attenuation layer.

28. The radiation attenuation shield of claim 26 further comprising a magnetic material layer that encases the attenuation layer.

29. A method of manufacturing a radiation attenuation shield comprising the steps of:

combining 20 to 85 percent by volume of a polymer, 5 to 55 percent by volume of a radiation attenuating material, and 10 to 70 percent by volume of a magnetic material to create a mixture;

inserting said mixture into a mold;

allowing said mixture to solidify to create a solidified mixture; and removing said solidified mixture from said mold.

30. The method of claim 29 further including the step of curing said mixture.

31. The method of claim 29 further including the step of combining said polymer with a catalyst.

32. A system for attenuating radiation including the steps of providing a radiation attenuation shield comprising 20 to 85 percent by volume of a polymer, 5 to 55 percent by volume of a radiation attenuating material, and 10 to 70 percent by volume of a magnetic material;

securing said radiation attenuation shield to a structure to limit radiation exposure surrounding said system.

33. The system of claim 32 wherein said structure radiates radiation and said radiation attenuation shield limits radiation from exiting said shield.

* * * * *